US005972590A

United States Patent [19]

Friour et al.

[11] Patent Number: 5,972,590

[45] Date of Patent: Oct. 26, 1999

[54] RADIOGRAPHIC PRODUCT EXHIBITING REDUCED DYE STAIN

[75] Inventors: Gerard A. Friour, rue Charles Dullin; Francoise M. Thomas, rue d'Autun, both of France

[73] Assignee: Eastman Kodak Company, Rochester, N.Y.

[21] Appl. No.: 08/811,751

[22] Filed: Mar. 6, 1997

Related U.S. Application Data

[63] Continuation-in-part of application No. 08/565,496, Nov. 30, 1995, abandoned.

[51] Int. Cl.[6] ..... G03C 1/14; G03C 1/815

[52] U.S. Cl. ..... 430/583; 430/139; 430/567; 430/933; 430/966

[58] Field of Search ..... 430/581, 583, 430/567, 139, 966, 933

[56] References Cited

U.S. PATENT DOCUMENTS

| | | | |
|---|---|---|---|
| 2,933,390 | 4/1960 | McFall et al. . | |
| 4,130,428 | 12/1978 | Van Doorselaer . | |
| 4,232,112 | 11/1980 | Kuse . | |
| 4,587,195 | 5/1986 | Ishikawa et al. . | |
| 4,609,621 | 9/1986 | Sugimoto et al. | 430/567 |
| 4,639,411 | 1/1987 | Daubendiek et al. . | |
| 5,238,793 | 8/1993 | Hoyen . | |

OTHER PUBLICATIONS

Research Disclosure, Vo. 231, Jul. 1983, Items 23136, pp. 249–250.

*Primary Examiner*—Thorl Chea
*Attorney, Agent, or Firm*—Carl O. Thomas

[57] ABSTRACT

The present invention concerns a radiographic product which makes it possible to obtain an image with no residual yellow coloring. The radiographic product comprises at least one photosensitive silver halide tabular grain emulsion spectrally sensitized with a spectral sensitizing dye in the blue region having an emission peak between 400 and 500 nm, and an optical brightener derived from 4,4'-diaminostilbene disulfonic acid having at least three anionic sulfo groups, put in the photosensitive layer of the radiographic products or in at least one layer situated between the photo-sensitive layer and the support. The radiographic product is applicable to radiographic systems including one or two intensifying screens.

4 Claims, 7 Drawing Sheets

RADIOGRAPHIC PRODUCT EXHIBITING REDUCED DYE STAIN

This is a continuation-in-part of U.S. Ser. No. 08/565,496, filed Nov. 30, 1995 now abandoned.

FIELD OF THE INVENTION

The present invention concerns silver halide photographic products which are associated with X-ray intensifying screens and used in radiography. More precisely, the invention concerns a radiographic system containing at least one layer of spectrally sensitized tabular grain silver halide emulsion and an intensifying screen.

BACKGROUND

In radiography, particularly in medical radiography, use is normally made of radiographic systems comprising an intensifying screen and a radiographic film containing at least one radiation sensitive silver halide emulsion layer. The use of intensifying screens makes it possible to reduce the quantity of X-rays required to obtain a radiograph and consequently to reduce the quantity of X-rays absorbed by the patient.

The photosensitive emulsion in the radiographic film is spectrally sensitized with a dye having a peak absorption that matches as closely as possible the maximum emission band of the intensifying screen. The radiographic film is comprised of a transparent (often blue tinted) film support coated on one of its faces and, preferably on both faces, with at least one layer of silver halide emulsion containing radiation sensitive silver halide grains.

Since the early 1980's it has been recognized that significant performance advantages can be realized by employing spectrally sensitized tabular grain emulsions in radiographic film. Spectral sensitization is achieved by adsorbing a spectral sensitizing dye having an absorption peak matched as closely as possible to the peak emission of the intensifying screen. The absorption peak can lie in any convenient region of the spectrum—including the blue, green or red region of the spectrum. For example, when an intensifying screen is employed that emits in the blue spectral region between 360 and 500 nm, a spectral sensitizing dye is employed having a maximum absorption in this same spectral range.

Daubendiek et al U.S. Pat. No. 4,639,411 describes a radiographic element which comprises an emulsion consisting of tabular silver halide grains capable of forming a latent image when it is exposed to light. This emulsion preferably consists of tabular grains with a thickness of less than 0.5 $\mu$m and an aspect ratio higher than 5:1.

Tabular grain emulsions achieve maximum sensitivity at a high level of sensitizing dye because of the high ratio of grain surface area to grain volume. A problem of residual dye stain has therefore emerged with the use of spectrally sensitized tabular grain emulsions in radiographic film. The dye stain is observed as a residual coloring in the areas which are unexposed or only slightly exposed. The problem is particularly objectionable when the tabular grains can a blue spectral sensitizing dye. As is understood in the art, blue spectral sensitizing dyes selectively absorb blue light and, hence, are yellow in color. The yellow color imparted by residual, unrermoved blue spectral sensitizing dye imparts a warm image tone to the film. That is, instead having a neutral color the black-and-white imaged film is shifted toward a brown appearance. In medical radiography user preference is for cold (blue black) image tones. The problem of dye stain is exacerbated by rapid processing. In rapid processing imagewise exposed dry radiographic film is supplied to a processor and emerges from the processor dry bearing a developed image in less than 1 minute. The short processing interval limits the time available for spectral sensitizing dye transfer from the film to the processing solution.

In order to avoid dye stain, a common approach is to limit the choice of spectral sensitizing dye. This invention makes it possible to use spectral sensitizing dyes which, if they were used alone in high quantities, would have caused a residual coloring in the areas of the image of low density. According to the invention, this coloring is avoided by associating therewith an optical brightener having special characteristics. One advantage of the invention is that it affords a greater degree of freedom in the choice of spectral sensitizing dyes. In addition, surprisingly, the sensitometric properties of the radiographic image are not substantially impaired by the presence of the optical brightener according to the invention.

The optical brighteners which have been known for a long time are substances which absorb ultraviolet light in the region of the spectrum lying between 300 and 400 nm and which are fluorescent in the blue region of the visible spectrum. They are used for improving the whiteness of photographic papers and in photographic films. Research Disclosure of July 1983, No 23136, describes inter alia the use of optical brighteners in radiographic systems. According to this article, the presence of optical brighteners reduces the yellow appearance of the supporting polymer when a source of ultraviolet light is used. The optical brightener is incorporated in a layer placed on the support, or on the support by soaking the support in a solution containing the optical brightener, for example a developing or fixing solution or a stabilizing bath. This article does not deal with the problem of the residual coloring due to the spectral sensitizing dye.

McFall et al U.S. Pat. No. 2,933,390 describes a supersensitization method of silver halide emulsions which combines the use of diamino stilbene optical brighteners with dicarbocyanine dyes. Supersensitization which is a technique well described in the literature, consists in increasing the spectral sensitivity of a dye by the addition of another substance showing a strong adsorption in the near UV, and having an electron system similar to the dye with which it is associated. McFall associates specific dicarbocyanine dyes with the aminostilbene. The supersensitization would not be observed if dyes other than those of McFall were used e.g. carbocyanine dyes or, as in the present invention mono methine cyanine dyes. Also, the problem raised and solved by the present invention is very remote from the problem addressed in McFall U.S. Pat. No. 2,933,390, and certainly not described, even inherently, in this reference.

Kuse U.S. Pat. No. 4,232,112 describes a process for developing a color photographic film in which the development solution or the bleaching/fixing solution comprises a bleaching agent which is a derivative of 4,4'-diaminostilbene disulfonic acid and a second compound derived from benzene sulfonic or naphthalene sulfonic acid. This process makes it possible to avoid on the one hand the residual coloring due to oxidation of the color developer in the bleaching/fixing solution and on the other hand the residual coloring which is due to the accumulation of various substances on the edges of the film.

Ishikawa U.S. Pat. No. 4,587,195 describes a method for eliminating the residual coloring in a color image. For this purpose a development solution is used comprising a combination of optical brighteners of the triazylstilbene type with slightly shifted absorption peaks.

Hoyen U.S. Pat. No. 5,238,793 describes a method of processing black and white films, particularly microfilms, comprising a layer of silver halide emulsion spectrally sensitized with a cyanine dye. When the rate of replenishment of the processing solution is low or when the level of sensitizing dye is high, the spectral sensitizing dye forms in the processing solutions solid particles which adhere to the surface of the film and form specks or blotches on the final image. The problem is solved when the exposed film is processed in the presence of a stilbene which enables the spectral sensitizing dye to dissolve. Neither radiographic film, tabular grain emulsions, nor dye stain is addressed by Hoyen.

SUMMARY OF THE INVENTION

A problem which the present invention addresses is that of residual dye stain in a radiographic film containing a tabular grain emulsion sensitized to the blue region of the spectrum.

In one aspect, this invention is directed to a radiographic product comprised of a support and, coated on this support, (i) at least one photosensitive hydrophilic colloid layer comprising photosensitive silver halide tabular grains, the grains having adsorbed thereon a spectral sensitizing dye in the blue region having an absorption peak in the wavelength range from 400 and 500 nm and, (ii) a 4,4'-diaminostilbene disulfonic acid having at least 3 anionic sulfo groups.

In another aspect the invention is directed to a radiographic system comprised of at least one X-ray intensifying screen with maximum emission between 360 and 500 nm and the radiographic product as defined above.

The dye stain problem created by formation of a residual yellow coloring due to the absorption of the aggregate of residual spectral sensitizing dye in the gelatin of the processed element is overcome when the 4,4'-diaminostilbene optical brightener is put in at least one of the photosensitive layers of the radiographic product or in at least one layer of gelatin located between the photosensitive layer and the support.

In the definition above of the 4,4'-diaminostilbene, anionic sulfo group means an ionized —$SO_3$-group associated with a cation balancing the ionic charge by opposition to an acid group —$SO_3H$.

BRIEF DESCRIPTION OF THE DRAWINGS

In the following description, reference will be made to the drawings in which.

DESCRIPTION OF PREFERRED EMBODIMENTS

Figure 1:
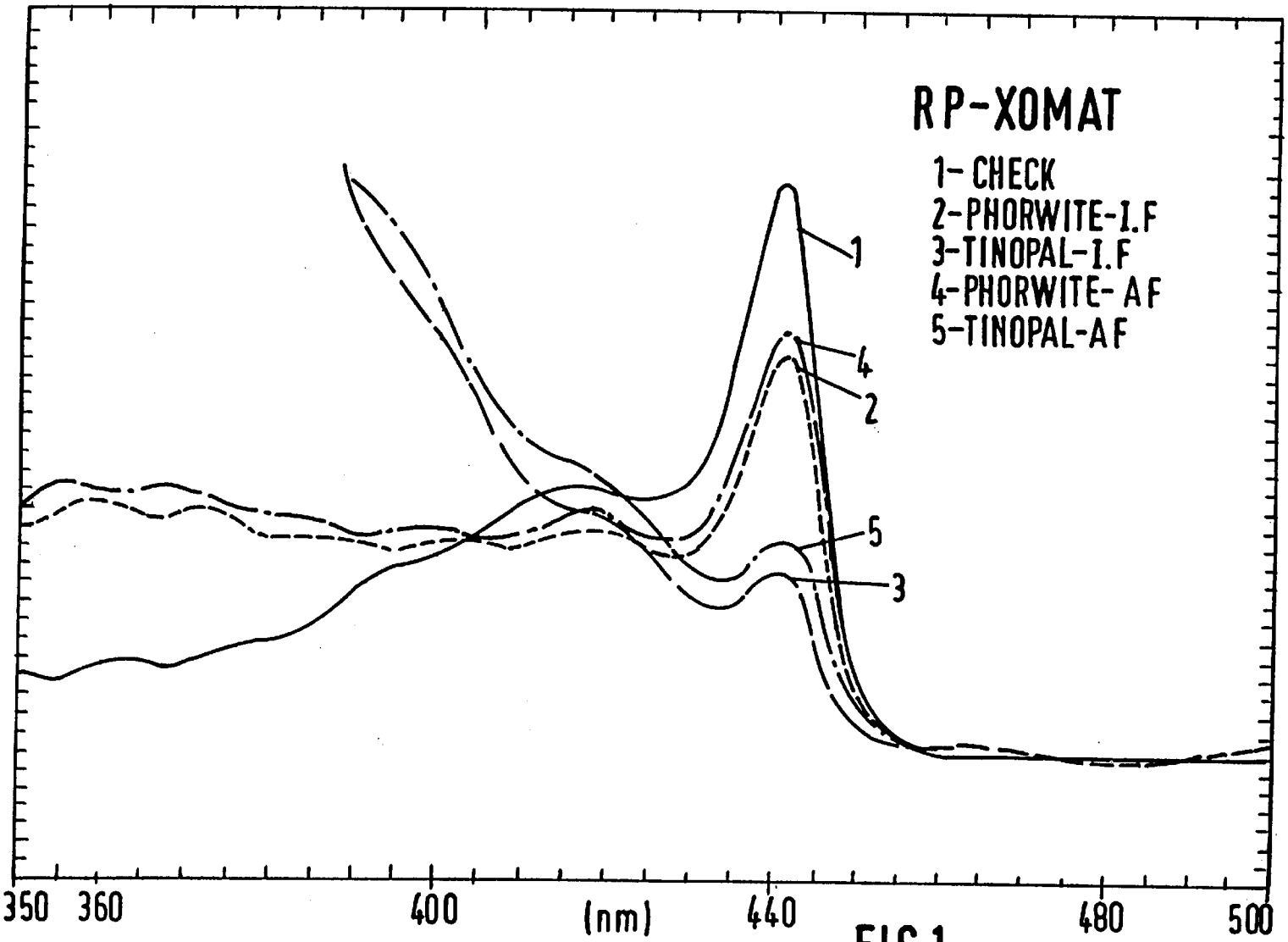
FIG. 1 shows the absorption spectrum between 350 and 500 nm for the RP-XOMAT® process, the optical brightener being in the emulsion layer.

The emulsions according to the invention are emulsions with tabular grains of silver chloride, silver bromide, silver iodide or a mixture of these halides, in a binder.

The binder is a water-permeable hydrophilic colloid such as gelatin, gelatin derivatives, albumin, a polyvinyl alcohol, polyvinyl polymers, etc.

The emulsions may be hardened in accordance with one of the methods described in U.S. Pat. No. 4,425,266. The hardening agents which may be used are described in Research Disclosure, December 1989, No 308113, Section X.

In addition to the characteristics specifically described above, the emulsions may comprise other compounds such as anti-fogging agents, stabilizers or anti-static agents. The radiographic film may comprise an overcoat containing matting agents. This overcoat or the sensitive layer may contain plasticisers or lubricants. These compounds were described in Research Disclosure, Vol 184, August 1979, No 18431.

These silver halide emulsions of the invention are preferably chemically sensitized by means of sulfur and/or gold and/or selenium, in accordance with the conventional chemical sensitization methods described in Research Disclosure, December 1989, No 308119, Section III.

The emulsions of the invention are spectrally sensitized. The conventional spectral sensitization. methods which can be used within the scope of the invention are described in Research Disclosure, December 1989, No 308119, Section IV.

The spectral dyes which can be used in the present invention are the blue spectral dyes which are liable to produce residual coloring, such as for example cyanine or merocyanine dyes. Cyanine dyes are described in Research Disclosure, December 1989, No 308119, Section IV A–C. Cyanine dyes which can be used according to the invention correspond to the formula:

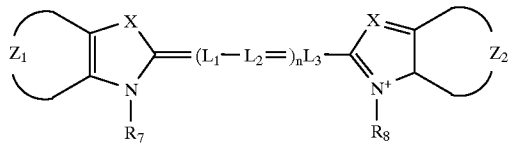

where $Z_1$ and $Z_2$ represent the atoms necessary to complete a substituted or unsubstituted aromatic ring structure; $R_7$ and $R_8$ each separately represent a substituted or unsubstituted alkyl radical having 1 to 12 carbon atoms, which may be substituted by a halogen, an alkoxy, aryl, aryloxy, sulfo or carboxyl radical; $L_1$, $L_2$ and $L_3$ each separately represent a methine bond, substituted or unsubstituted; X is O, S, Se, —C— or N— and n is 0, 1 or 2.

Examples of cyanine dyes liable to produce a residual coloring are as follows:

A

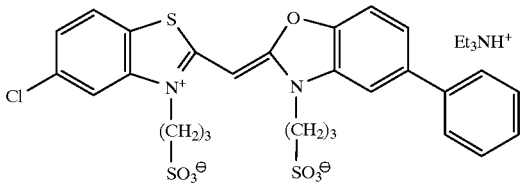

B

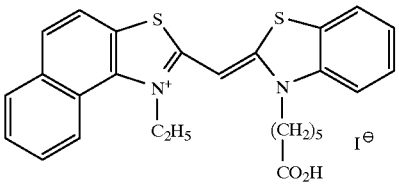

C

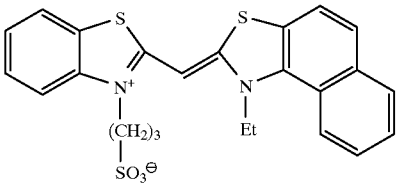

D

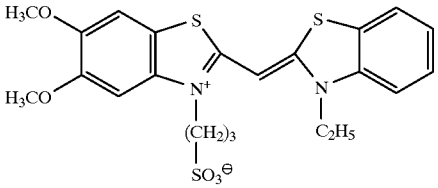

E

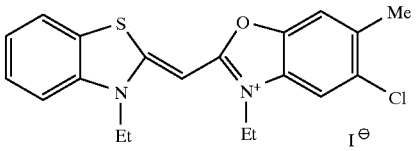

F

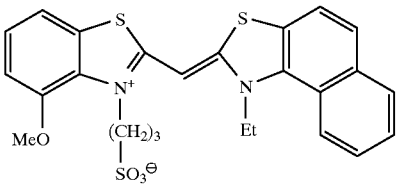

-continued

G

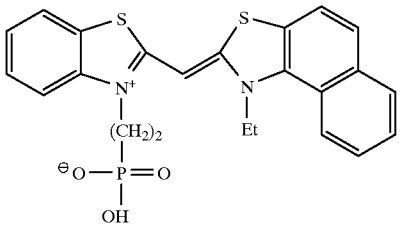

H

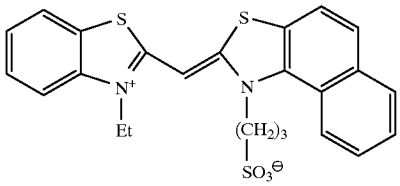

I

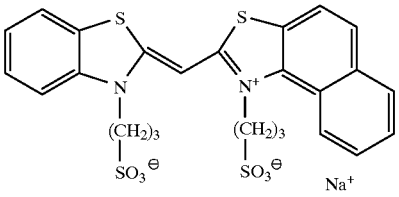

An appropriate amount of spectral sensitizing dye depends widely on the level of sensitization required, the size of the tabular grains, especially the area of the main faces. Typically, the amount of sensitizing dye is in the range of from 0.1 to 1.5 mg/Ag mole, and more preferably in the range of from 0.2 to 0.8 mg/Ag mole.

The optical brighteners which can be used in the present invention must be capable of destroying the aggregate of the residual sensitizing dye in the gelatin, which reduces the optical density corresponding to the residual coloring, giving rise to chemical species in which the wavelength of the absorption peak lies in a region of the visible spectrum where the sensitivity of the eye is low, preferably around the wavelengths below 420 rm. In addition, these optical brighteners must have a sufficient number of solubilizing groups to be able to be retained in the gelatin in the layers of the photographic product.

Examples of optical brighteners which can be used in the present invention are compounds of the stilbene type having at least three anionic sulfo groups. For example it is possible to use compounds having the formula:

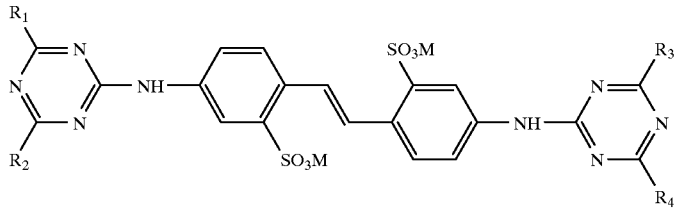

where $R_1$, $R_2$, $R_3$ and $R_4$ are each separately chosen from

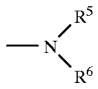

halogen, hydrogen, hydroxy, substituted or unsubstituted alkyl, substituted or unsubstituted aryl, substituted or unsubstituted alcoxy and sulfo, $R_5$ and $R_6$ are each separately chosen from amongst hydrogen, substituted or unsubstituted alkyl, and substituted or unsubstituted aryl, M is a cation balancing the ionic charge, with the proviso that the compound has at least one solubilizing anionic sulfo group on $R_1$, $R_2$, $R_3$ or R.

Examples of useful compounds are described in Table I in U.S. Pat. No. 5,238,793, previously cited. Compounds which are preferred according to the invention are Phorwite® of formula:

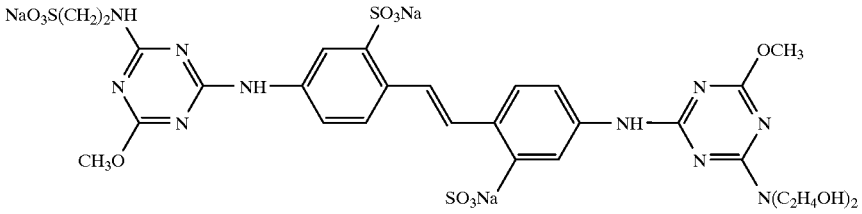

and Tinopal® of formula:

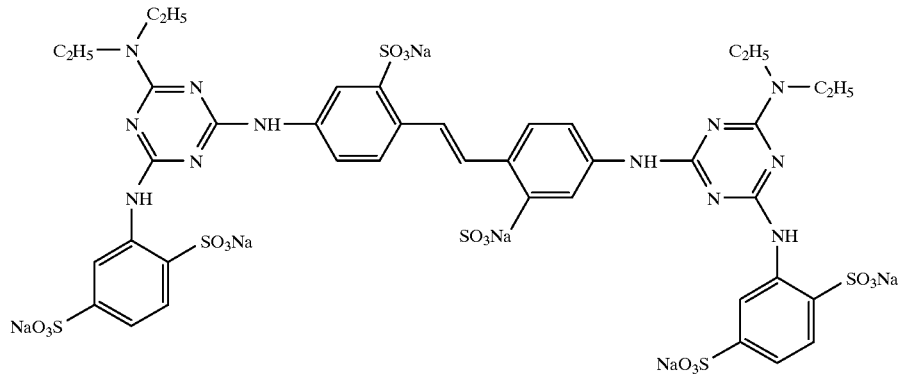

The quantity of optical brightener is determined so that the residual coloring due to the spectral sensitizing dye is highly attenuated without the sensitometric or physical properties of the radiographic product being impaired. In particular, it is desired that the photographic sensitivity, the reciprocity failure, the sensitivity to pressure and the keeping during incubation (fog/speed ratio) should not be substantially modified.

A typical quantity of optical brightener is between 0.05 and 2 mg/dm$^2$ and preferably between 0.5 and 1.5 mg/dm$^2$.

In addition to the radiographic film, radiographic systems generally comprise a pair of X-ray intensifying screens situated on each side of the radiographic film.

The intensifying screens used in the invention have an emission peak in the blue or ultraviolet region whose wavelength is between 360 and 500 nm.

The X-ray intensifying screens comprise one or more luminophores in a mixture with a binder. The luminophore particle size is generally between 0.5 and 20 $\mu$m and preferably between 1 and 10 $\mu$m.

Examples of luminophores emitting in the blue or ultraviolet region are calcium tungstate $CaWO_4$, lanthane oxybromide LaOBr activated by terbium or thulium, gadolinium oxybromide activated by yttrium or cerium, $YTaO_4$ activated by gadolinium, bismuth, lead, cerium, barium fluorochloride BaFCl activated by europium, gadolinium, lanthanum or yttrium, or barium sulfate activated by europium or strontium.

Usable binders are chosen from among the organic polymers transparent to light radiation and to X-rays, such as vinyl alcohol and o-sulfobenzaldehyde acetal polyrmers, chlorosulfonated polyethylenes, bisphenol polycarbonzites, alkyl acrylate and methacrylate copolymers and polyurethanes. Other binders which can be used within the scope of the invention are described in U.S. Pat. Nos. 2,502,529, 2,887,379, 3,617,285, 3,300,310, 3,300,311 and 3,743,833 and in Research Disclosure, Vol 154, February 1977. The preferred binders are polyurethanes such as Estane®, Permuthane® and Cargill®.

The X-ray intensifying screens may contain, in addition to the fluorescent layer, a protective layer and a reflective layer.

The methods of manufacturing screens and radiographic films are described in the above-mentioned Research Disclosure No 18431, August 1979.

*Research Disclosure* is published by Kenneth Mason Publications, Ltd., Dudley House, 12 North St., Emsworth, Hampshire P010 7DQ, England.

EXAMPLES

The following examples illustrate the invention.

Examples 1–3

The films described in Examples 1–3 consist of an star®, poly(ethylene terephthalate) film support coated, in the following order, with a layer of tabular grain silver bromide emulsion having a grain equivalent diameter of 2.14 $\mu$m and a mean grain thickness of 0.11 $\mu$m and an overcoat of gelatin. In Example 2, the film also comprises a layer of gelatin placed between the emulsion layer and the support. The film is hardened by means of bis(vinylsulfonylmethyl) ether, the amount of hardening agent by weight being equal to 2.25% of the total dry gelatin contained in the film. The emulsion is optimally chemically sensitized by means of sulfur (150 mg KSCN per mole of Ag), gold (5.06 mg $Na_3(S_2O_3)_2Au,2\ H_2O$ per mole of Ag) and selenium (0.67 mg KSeCN per mole of Ag). The emulsion is optimally spectrally sensitized with spectral sensitizing dye A.

The samples of film are exposed to blue light simulating the exposure obtained through an intensifying screen.

The exposed films are then processed using a conventional RP-XOMAT® process in 90 seconds and a fast KRA® process in 45 seconds.

After processing, the residual coloring levels are measured by spectrophotometry at 440 nm (the wavelength corresponding to the absorption peak of the aggregate of the sensitizing dye in the gelatin), the reciprocity failure for an exposure of between 1/50th and 5 seconds, the spectral sensitivity between 300 and 500 nm. In this way it is verified that no loss of sensitivity occurs in the near ultraviolet because of the absorbency of the optical brightener.

The resistance to pressure is estimated by using a pressure roller simulating mechanical stresses.

Example 1

In this example, the optical brightener is put in the emulsion layer of the radiographic product.

A simplified format of radiographic product is used, as described above and comprising a colorless Estar® support, a tabular grain silver bromide emulsion (21 mg Ag/dm$^2$, 2.85 mg/dm$^2$ gelatin, 465 mg of spectral sensitizing dye A per mole of Ag), and an overcoat of gelatin (6.88 mg/dm$^2$). 0.6 mg/dm$^2$ of optical brightener (Tinopal® or Phorwite®) is introduced into the emulsion layer either before spectral sensitization (IF) or immediately after (AF). The products are processed in automatic processors for the RP-XOMAT® and KRA® processes.

Figure 2:
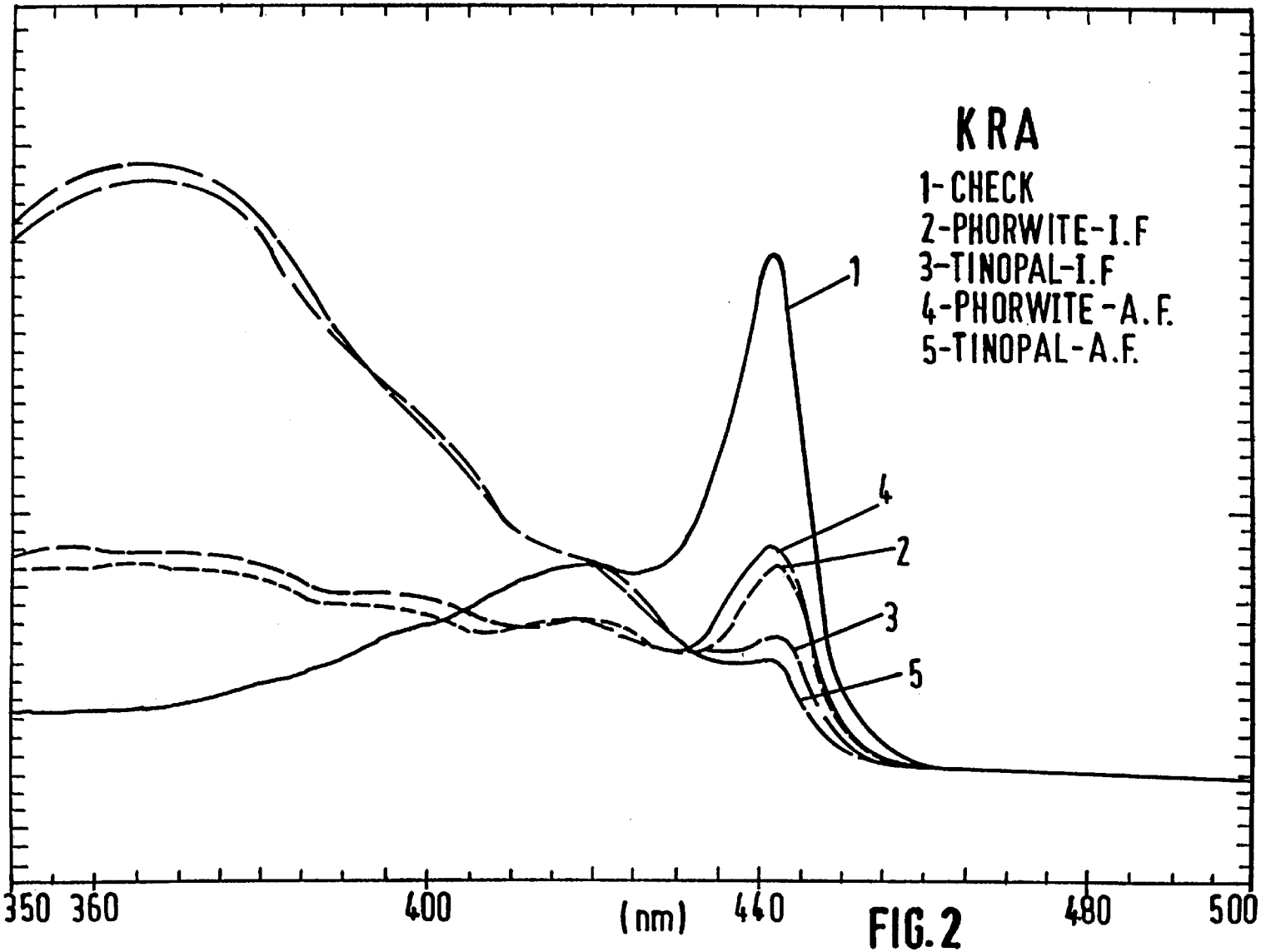
FIG. 2 shows the absorption spectrum between 350 and 500 nm for the KRA® process, the optical brightener being in the emulsion layer.

The results are given in FIGS. 1 and 2, where

1-Check represents the control product which does not contain any optical brightener in the emulsion layer, 2-Phorwite® IF (or 3-Tinopal® IF) represents the product according to the invention in which the optical brightener has been introduced into the emulsion before the sensitization, and 4-Phorwite® AF (or 5-Tinopal® AF) represents the product according to the invention in which the optical brightener has been introduced into the emulsion after sensitization.

FIGS. 1 and 2 show the absorption spectrum between 350 and 500 nm. The yellow residual dye, due to the aggregate of the sensitizing dye retained in the gelatin, corresponds to the principal peak situated at 440 nm. A less prominent peak can be seen, corresponding to the monomeric sensitizing dye at around 410 nm.

In the presence of the optical brightener according to the invention, a reduction in the height of the peak at 440 nm is observed, and a modification of the spectrum between 420 and 350 nm, which is explained by the destruction of the dye aggregate in the gelatin and the formation of species resulting from the interaction between the optical brightener and the aggregate of the dye in the gelatin.

Figure 3:
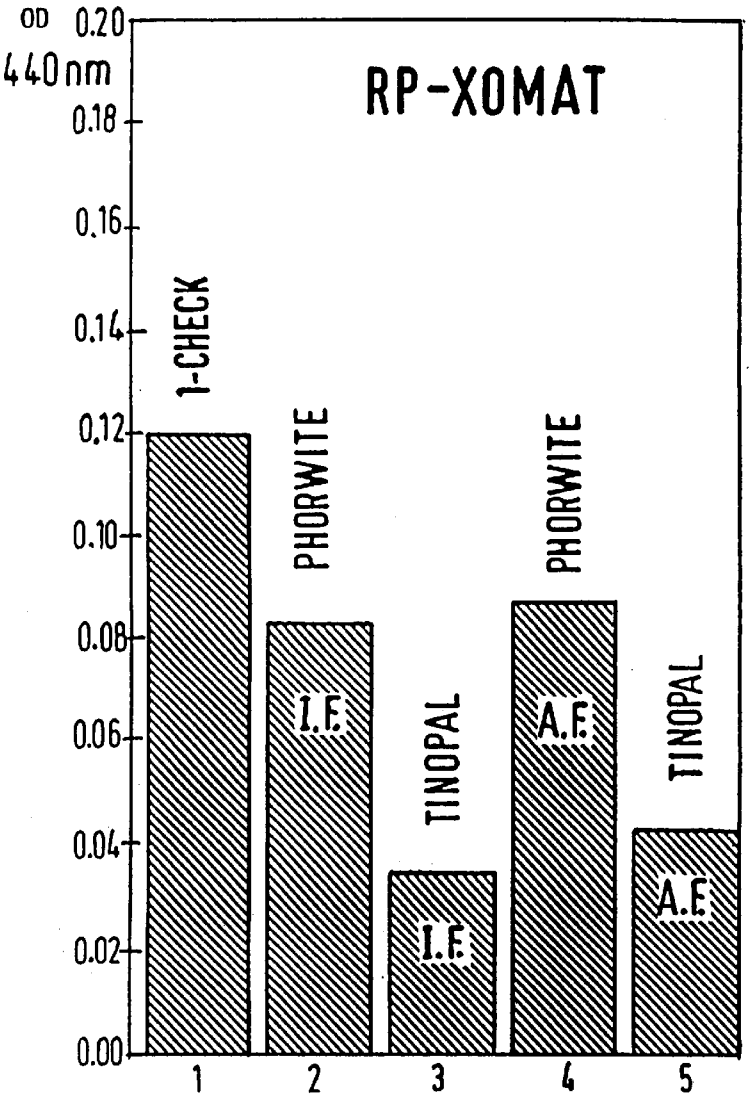
FIG. 3 shows the optical density of the residual coloring at 440 nm for the RP-XOMAT® process, the optical brightener being in the emulsion layer.
Figure 4:
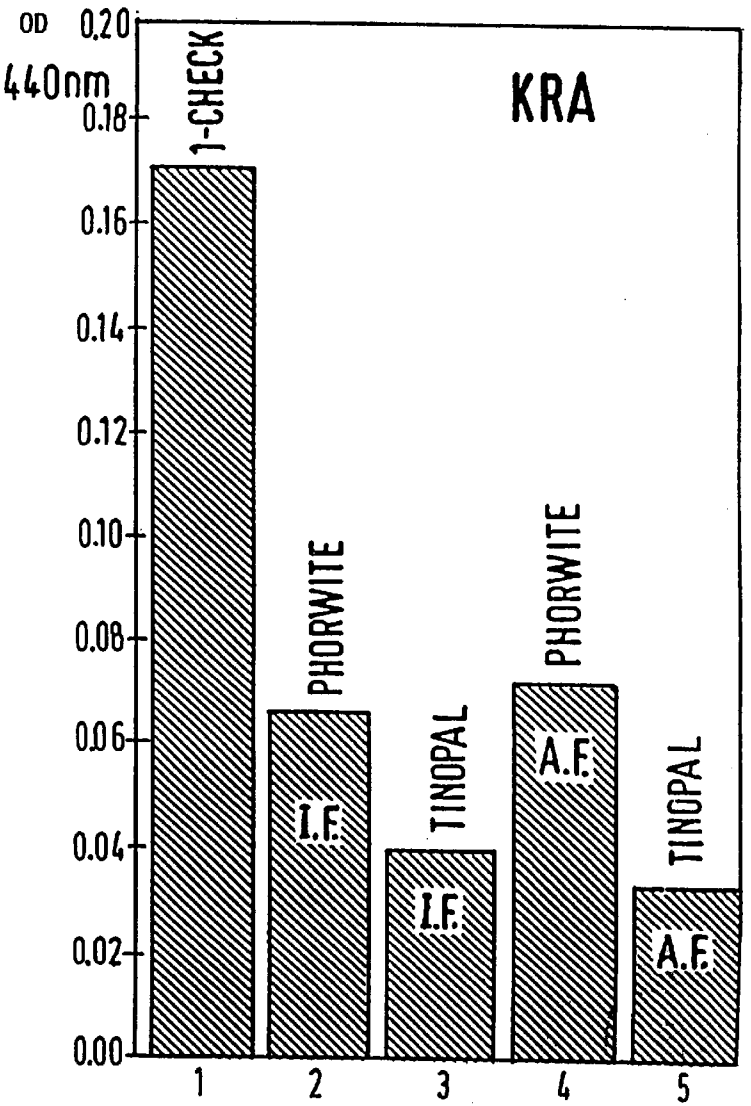
FIG. 4 shows the optical density of the residual coloring at 440 nm for the KRA® process, the optical brightener being in the emulsion layer.

FIGS. 3 and 4 show the optical density of the residual coloring at 440 nm for the RP-XOMAT® and KRA® processes. In these figures, 1-CHECK represents the check sample.

It can be seen that the method of introducing the optical brightener (before or after the spectral sensitizing dye) is not critical.

In the fast KRA® process, the shortening of the development cycle compared with the RP-XOMAT® process causes an aggravation of the residual coloring in the absence of any optical brightener. The best result for both the KRA® process and the RP-XOMAT® process is obtained with Tinopal®, this improvement being particularly noticeable in the KRA® process.

In all cases, the presence of an optical brightener in the emulsion layer causes a loss of sensitivity of around 0.03 to 0.06 log H (where H represents the value of the illumination expressed in lux.sec) whilst the other parameters such as the maximum density (Dmax), the minimum density (Dmin) and the contrast are practically unaffected. The reciprocity failure increases, but the sensitivity to pressure and the fog of the products when fresh or after incubation are unchanged.

The invention makes it possible to eliminate up to 82% of residual coloring in the RP-XOMAT® process and up to 90% of residual color in the KRA® process without excessively impairing the sensitometric characteristics.

Example 2

In this example, the optical brightener is located in a layer placed between the emulsion layer and the support. This arrangement may be useful where it is difficult to introduce the optical brightener into the emulsion layer for practical reasons or where interactions with other additives could occur.

In this example, a simplified format of radiographic product is used, comprising, in the following order, a 20 mg/dm$^2$ gelatin layer between the support and the emulsion layer, a layer of tabular grain silver bromide emulsion (21 mg Ag/dm$^2$, 32 mg/dm$^2$ gel) and an overcoat of gelatin (6.88 mg/dm$^2$). A quantity of optical brightener (Tinopal® or Phorwite®) of respectively 0.3, 0.6 and 1.2 mg/dm$^2$ is introduced.

Figure 5:
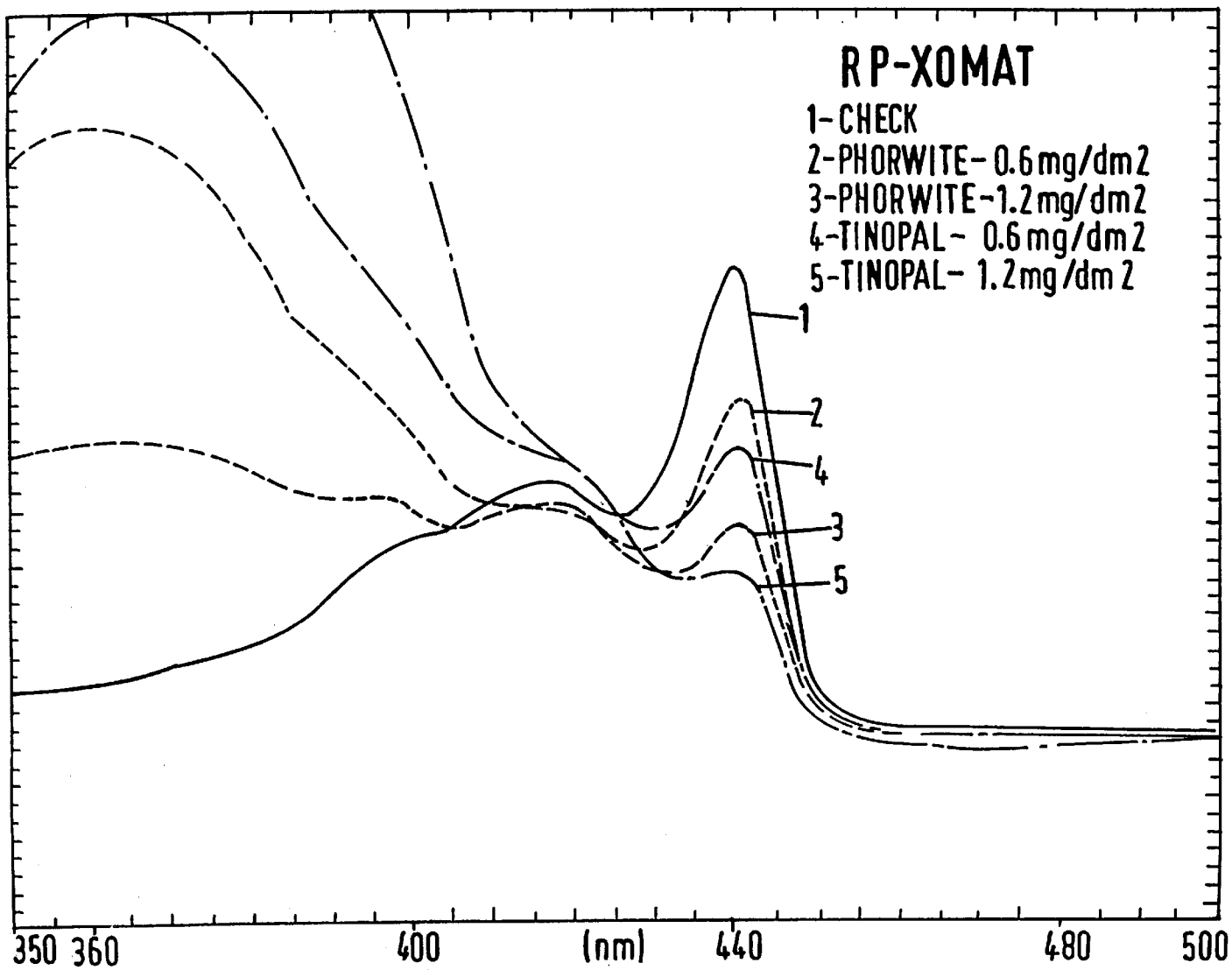
FIG. 5 shows the absorption spectrum between 350 and 500 nm for the RP-XOMAT® process, the optical brightener being in a layer of gelatin between the support and the emulsion layer.
Figure 6:
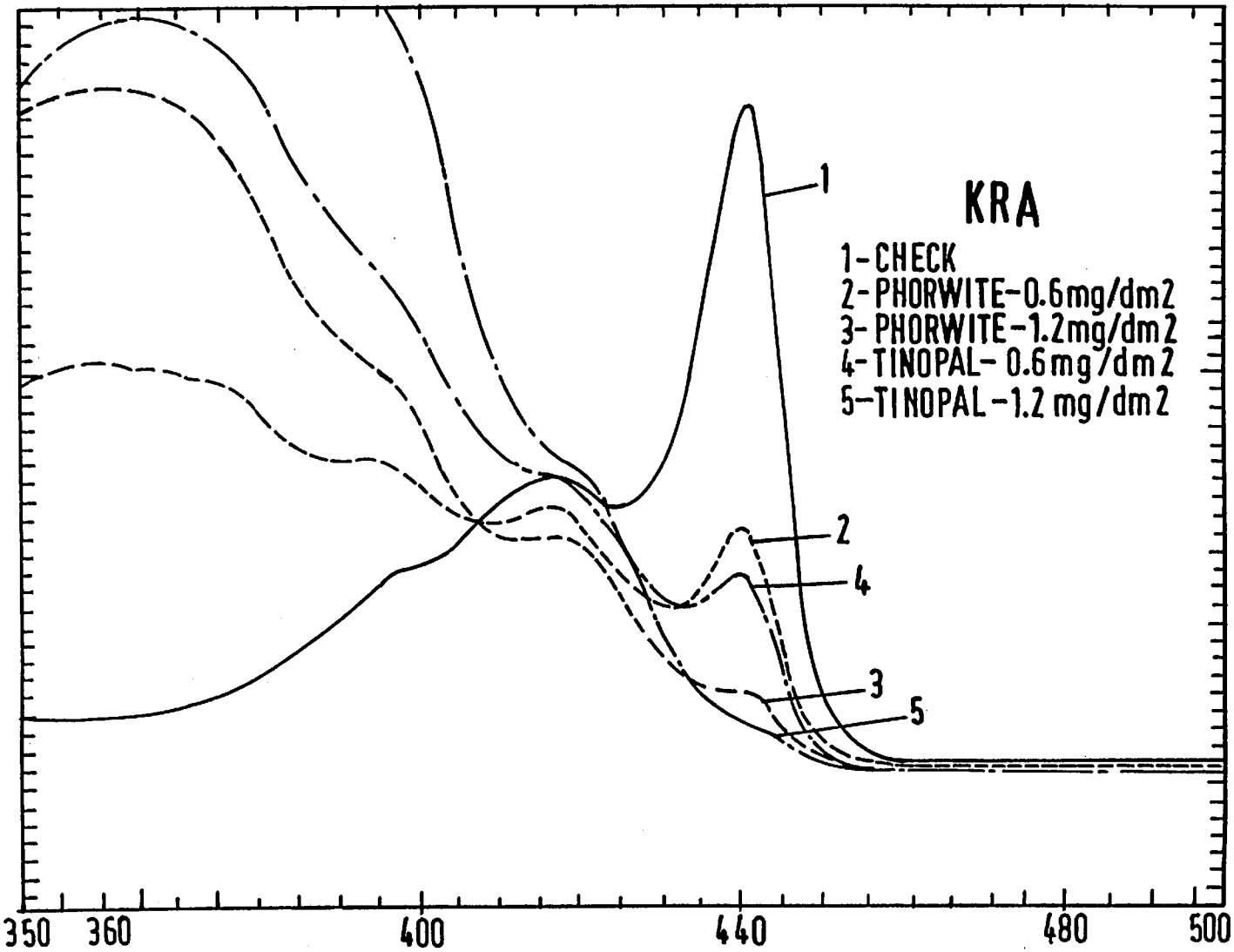
FIG. 6 shows the absorption spectrum between 350 and 500 nm for the KRA® process, the optical brightener being in a layer of gelatin between the support and the emulsion layer.

FIGS. 5 and 6 show the absorption spectrum between 360 and 450 nm. It can be seen that the two compounds make it possible to reduce the residual coloring (lowering of the peak at 440 nm) and are more efficacious in the KRA® process.

Figure 7:
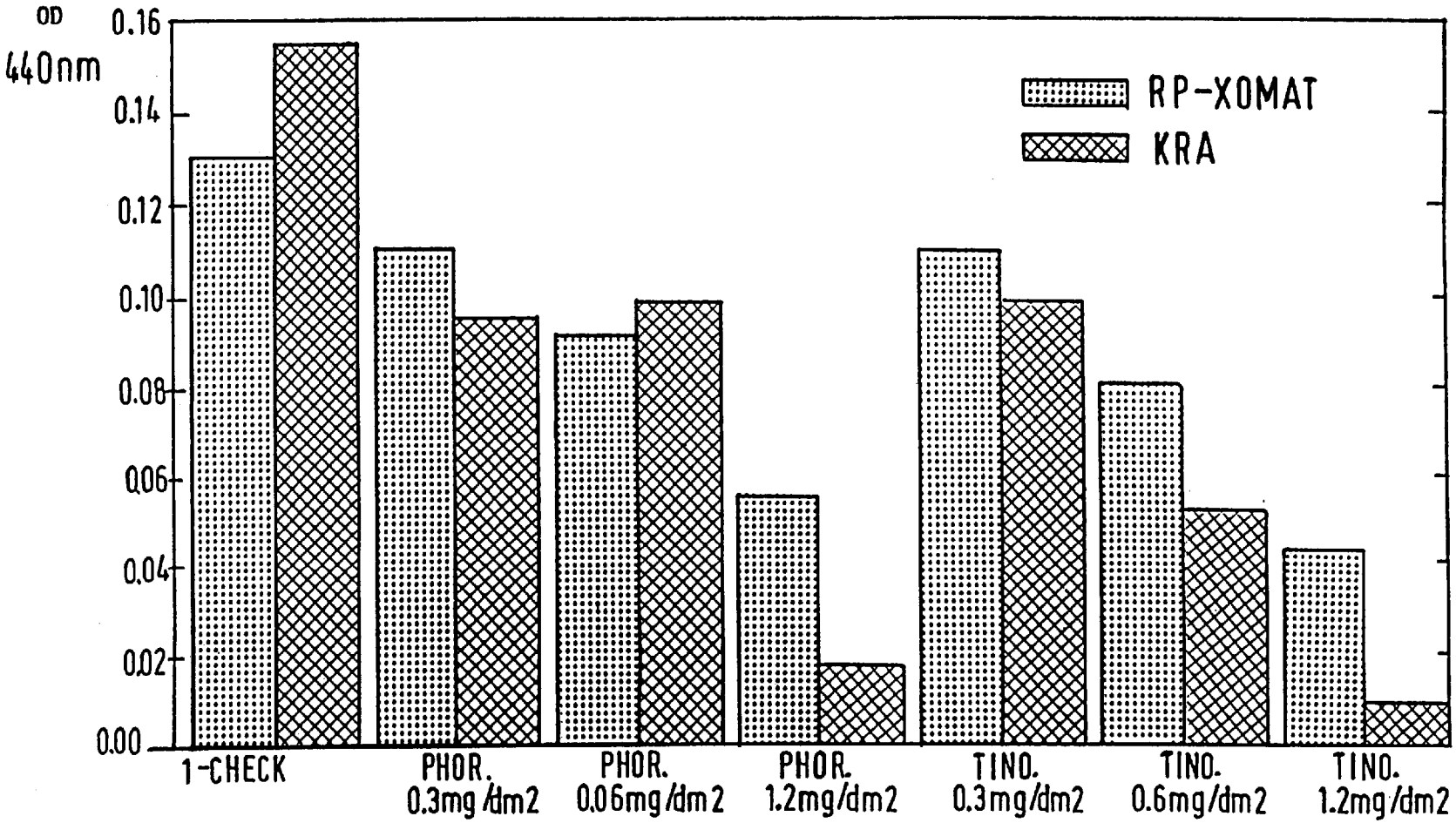
FIG. 7 shows the optical density of the residual coloring at 440 nm for the RP-XOMAT® and KRA® processes, the optical brightener being in a layer of gelatin between the support and the emulsion layer.

FIG. 7 shows the optical density at 440 nm, which corresponds to the residual coloring. CHECK represents the control. The best results are obtained with Tinopal® at a concentration of 1.2 mg/m$^2$.

In all cases, the presence of the optical brightener beneath the emulsion layer causes no loss of sensitivity, and the other parameters such as Dmax, Dmin and contrast are practically unaffected. The reciprocity failure, sensitivity to pressure and fog of the product when fresh or after incubation are unchanged.

The invention makes it possible to eliminate up to 70% of residual coloring in the RP-XOMAT® process and up to 94% of residual coloring in the fast KRA® process without impairing the sensitometric characteristics.

Example 3 (Comparative)

In this example, a quantity of Phorwite® of 0.4 and 0.6 mg/dm$^2$ respectively is introduced into the gelatin overcoat.

Figure 8:
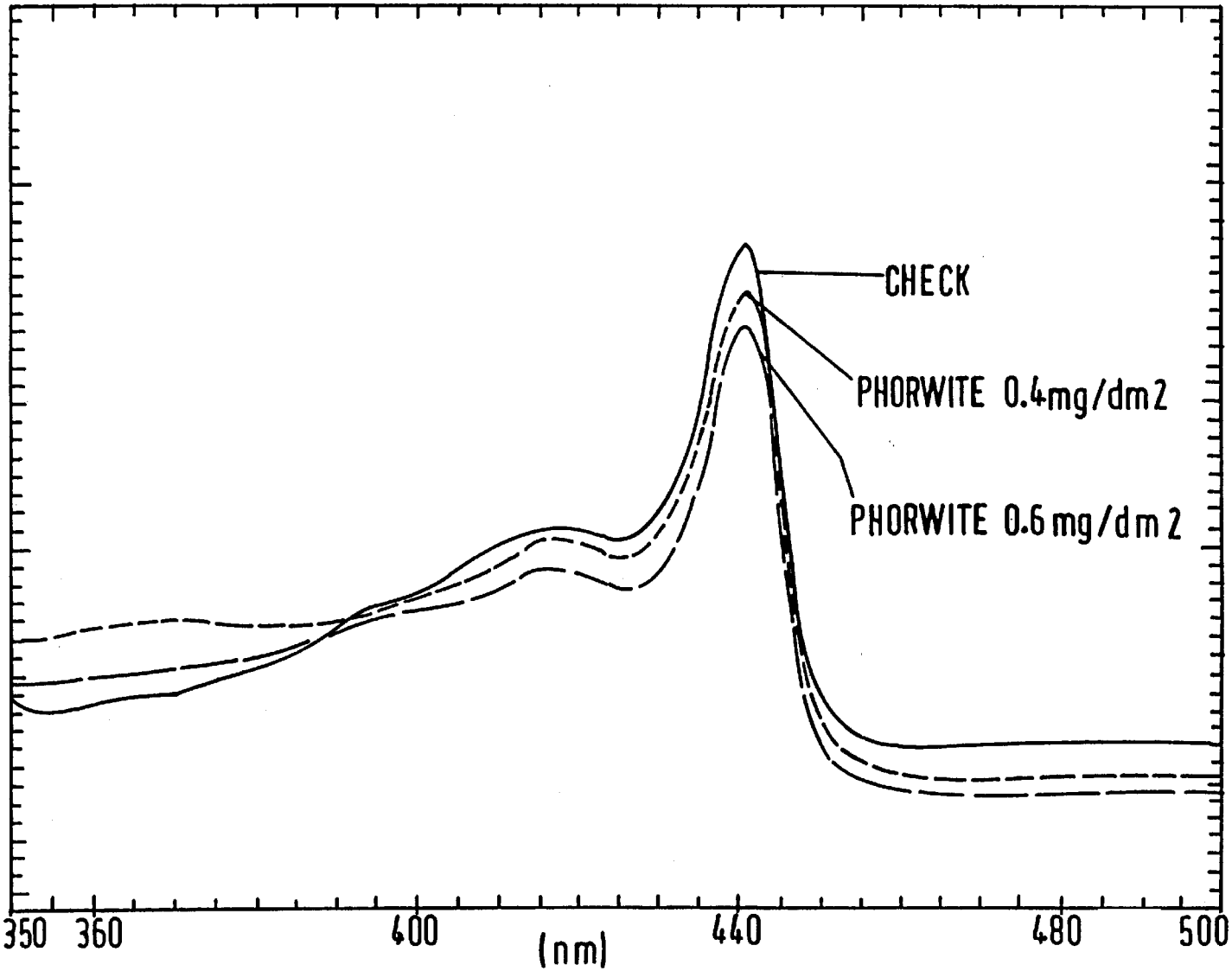
FIG. 8 shows the absorption spectrum between 350 and 500 nm for the RP-XOMAT® process, the optical brightener being in an overcoat of gelatin.

FIG. 8 shows the absorption spectrum between 350 and 500 nm, for the RP-XOMAT® process.

It can be seen that the effect of the optical brightener is weaker where it is put in the overcoat since it is possible to eliminate only 15% of residual coloring. The sensitometric characteristics are not affected.

In conclusion, the best compromise enabling the residual coloring to be reduced without for all that modifying the sensitometric characteristics is obtained by putting the optical brightener in the gelatin layer of the photographic product placed between the emulsion layer and the support. In Example 2, 90% of residual coloring is eliminated in the fast KRA® process and 67% of residual coloring in the RP-XOMAT® process with a concentration of Tinopal® of 1.2 mg/m$^2$ without the sensitometric characteristics being affected.

Examples 4–5

In these examples, the normal format of radiographic film is used. On both sides of a blue Estar® support, are coated, in the following order, a layer of tabular grain silver bromide emulsion (32 mg/dm$^2$ gel, 21 mg/dm$^2$ Ag), an intermediate layer of gelatin (3.54 mg/dm$^2$ gel) and an overcoat of gelatin (3.54 mg/dm$^2$ gel). In Example 5, the film also comprises a layer of gelatin (14 mg/dm$^2$ gel) placed between the emulsion layer and the support. The film is hardened by means of bis(vinylsulfonylmethyl) ether, the amount of hardening agent by weight being equal to 2.35% of the total dry gelatin contained in the film. The emulsion is chemically sensitized and spectrally sensitized with spectral sensitizing dye A as in Example 1.

Example 4

In this example, 0.6 mg/dm$^2$ of Tinopal® is introduced into the emulsion after sensitization.

The samples of film are exposed to blue light by means of a conventional Kodak X-Omat® intensifying screen.

The exposed films are then processed with an RP-XOMAT® process in 90 seconds and a KRA® process in 45 seconds, as in the previous examples.

The level of residual coloring is measured by spectrophotometry at 440 nm.

Compared with a control which does not include Tinopal®, a reduction of 70% in the optical density at 440 nm is observed in the RP-XOMAT® process and 86.5% in the KRA® process. A fairly large loss of sensitivity of around 0.08 to 0.1 Log H is also observed and an increase in the reciprocity failure. The other parameters such as Dmax, Dmin and contrast are practically unaffected. The sensitivity to pressure and the fog of the product when fresh or after incubation are unchanged.

Example 5

In this example, 1.2 mg/dm$^2$ of Tinopal® is introduced after sensitization into the layer of gelatin placed between the support and the emulsion layer.

The samples of film are exposed and processed using the RP-XOMAT® process in 90 seconds and the KRA® process in 45 seconds, as in the previous example.

The level of residual coloring is measured by spectrophotometry at 440 nm.

Compared with a control which does not include Tinopal®, a reduction of 80% in the optical density at 440 nm is observed in the RP-XOMAT® process and 93.5% in the KRA® process. Neither loss of sensitivity nor increase in the reciprocity failure are observed. The other parameters such as Dmax, Dmin and contrast are practically unaffected. The sensitivity to pressure and the fog of the product when fresh or after incubation are unchanged.

In conclusion, as in Examples 1 and 2, the best compromise enabling the residual coloring to be reduced without for all that modifying the sensitometric characteristics is obtained by placing the optical brightener in the gelatin layer of the photographic product placed between the emulsion layer and the support. In Example 5, up to 93.5% of residual coloring is eliminated in the fast KRA® process with a concentration of Tinopal® of 1.2 mg/m$^2$ without the physical and sensitometric characteristics being affected.

Example 6

The same procedure as in Example 1 was used, except the comparative optical brightener WIT 2020 not within the scope of the invention, was substituted for Tinopal® or Phorwite®.

The samples were exposed to blue light (2850° K., filter W39) for 1/15 s and then processed by rapid access treatment Kodak RA 480 for 45 s.

The results obtained are shown in Table I.

TABLE I

| Optical brightener WIT 2020 mg/dm$^2$ | Dmin | Sensitivity |
|---|---|---|
| 0 | 0.230 | 459.7 |
| 0.3 | 0.193 | 429.7 |
| 0.6 | 0.182 | 423.4 |

The optical brightener WIT 2020 has the formula:

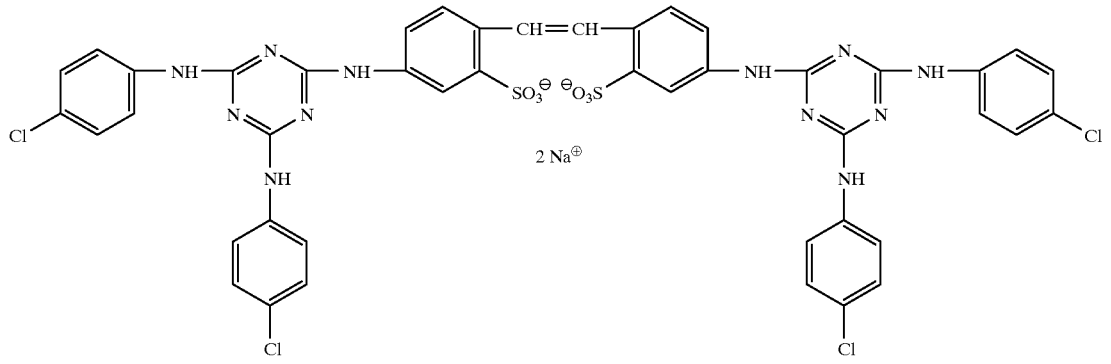

This optical brightener outside the invention does not eliminate the residual stain and, in addition provides a severe desensitization.

Example 7 (Comparative)

The same procedure as in Example 1 was used, except that 800 mg/dm$^2$ of the following green spectral sensitizing dye was substituted for dye A. Tinopal® was used as the optical brightener.

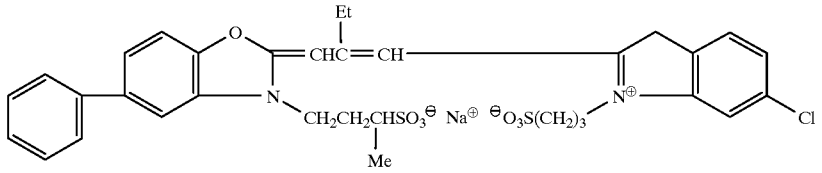

The samples were exposed as in Example 1, except that a filter C 4010 was used, and processed as in Example 1.

The results obtained are shown in Table II.

TABLE II

| Tinopal ® mg/dm$^2$ | Dmin | Sensitivity |
|---|---|---|
| 0 | 0.069 | 439.3 |
| 0.6 | 0.049 | 384.6 |

A significant amount of residual coloration remains at 511 nm and a severe desensitization is observed.

Example 6–7 illustrate that departing from the unique combination of the blue spectral sensitizer and 4,4'-diaminostilbene optical brightener according to the invention, makes it impossible to eliminate the residual colored stain and results in an adverse effect on the sensitivity.

The invention has been described in detail with particular reference to preferred embodiments thereof, but it will be understood that variations and modifications can be effected within the spirit and scope of the invention.

What is claimed is:

1. A radiographic product comprised of a support and coated on the support, (i) at least one photosensitive hydrophilic colloid layer containing photosensitive tabular silver halide grains, said grains having adsorbed thereon a spectral sensitizing dye having an absorption peak in the wavelength range from 400 to 500 nm, and having one of the following formulae A-I:

A

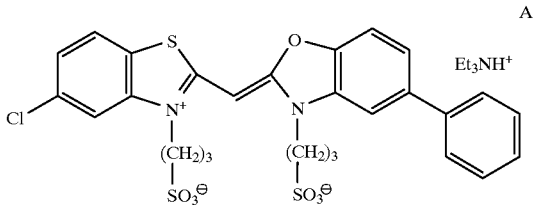

B

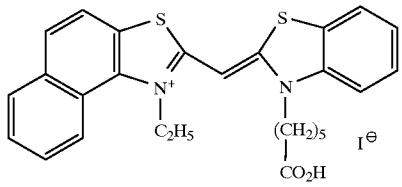

-continued

C

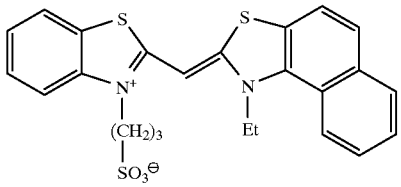

D

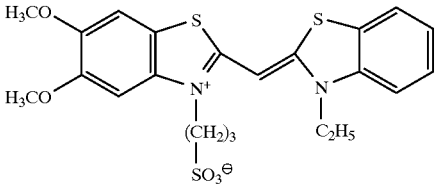

E

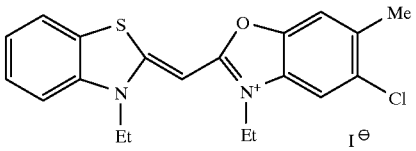

F

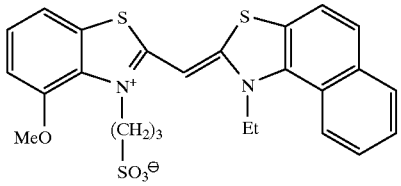

G

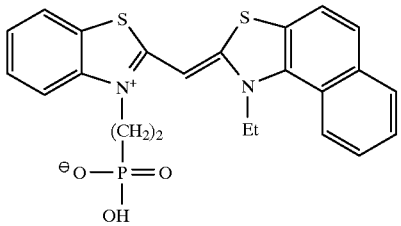

H

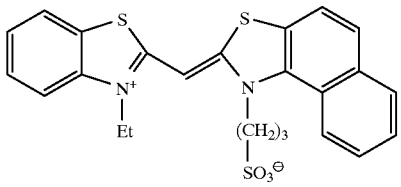

I

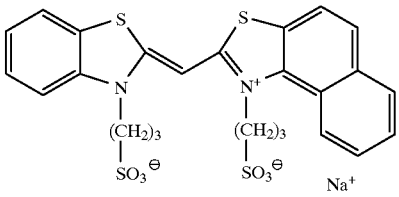

and (ii) located in a hydrophilic colloid layer between the support and the hydrophilic colloid layer containing the tabular silver halide grains, an amount from 0.05 to 2 mg/dm$^2$ of a 4,4'-diaminostilbene optical brightener having one of the following formulae:

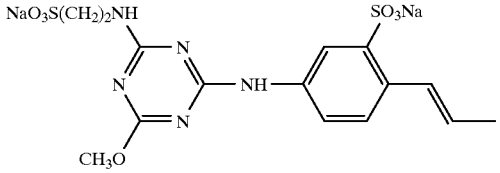

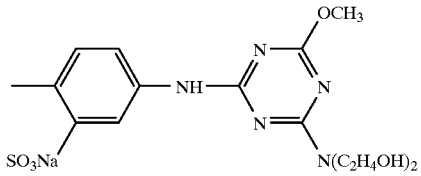

or

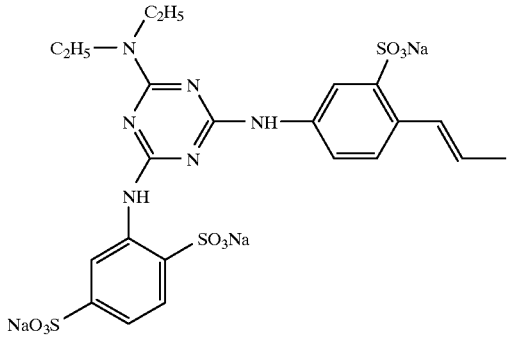

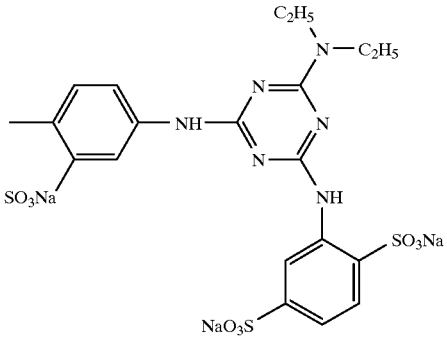

2. The radiographic product of claim 1, wherein the spectral sensitizing dye is a monomethine cyanine dye.

3. The radiographic product of claim 1, wherein the amount of 4,4'-diaminostilbene optical brightener is in the range of from about 0.5 to about 1.5 mg/dm$^2$.

4. A radiographic system comprised of at least one X-ray intensifying screen, having a maximum emission between 360 and 500 nm, and the radiographic product according to claim 1.

* * * * *